US008157879B2

(12) United States Patent
Sauer et al.

(10) Patent No.: US 8,157,879 B2
(45) Date of Patent: Apr. 17, 2012

(54) VACUUM CLEANER FILTER BAG WITH DEFLECTION DEVICE

(75) Inventors: Ralf Sauer, Overpelt (BE); Jan Schultink, Overpelt (BE)

(73) Assignee: Eurofilters Holding N.V., Overpelt (BE)

( * ) Notice: Subject to any disclaimer, the term of this patent is extended or adjusted under 35 U.S.C. 154(b) by 334 days.

(21) Appl. No.: 12/093,926

(22) PCT Filed: Nov. 22, 2006

(86) PCT No.: PCT/EP2006/011188
§ 371 (c)(1),
(2), (4) Date: Jul. 22, 2008

(87) PCT Pub. No.: WO2007/059936
PCT Pub. Date: May 31, 2007

(65) Prior Publication Data

US 2010/0058720 A1 Mar. 11, 2010

(30) Foreign Application Priority Data

Nov. 22, 2005 (EP) ..... 05025480
Nov. 28, 2005 (EP) ..... 05025904
Dec. 9, 2005 (EP) ..... 05027013

(51) Int. Cl.
*B01D 46/00* (2006.01)

(52) U.S. Cl. ..... 55/367; 55/368; 55/335; 55/361; 55/320; 55/374; 55/337; 55/DIG. 3; 15/347; 15/353; 15/DIG. 8; 95/273

(58) Field of Classification Search ..... 55/367, 55/368, 335, 361, 320, 374, 377, DIG. 2; 95/273; 15/347, 353, DIG. 8
See application file for complete search history.

(56) References Cited

U.S. PATENT DOCUMENTS

| | | | | |
|---|---|---|---|---|
| 2,068,332 A | | 1/1937 | Kneisley | |
| 2,605,858 A | * | 8/1952 | Lang | 96/382 |
| 3,370,405 A | | 2/1968 | Fesco | |
| 3,973,936 A | | 8/1976 | Howard et al. | |
| 4,468,498 A | | 8/1984 | Kowalski et al. | |
| 4,469,498 A | * | 9/1984 | Fish | 55/335 |
| 5,180,103 A | | 1/1993 | Harrison, Jr. et al. | |
| 5,603,741 A | | 2/1997 | Frey | |
| 5,755,009 A | * | 5/1998 | Stephens et al. | 15/347 |
| 5,820,643 A | * | 10/1998 | Lienenluke et al. | 55/367 |
| 1,316,442 A | | 9/1999 | Goughnour | |
| 6,045,595 A | * | 4/2000 | Freudenberg | 55/382 |

(Continued)

FOREIGN PATENT DOCUMENTS

BE 529 649 7/1954

(Continued)

OTHER PUBLICATIONS

International Search Report for International Application No. PCT/EP2006/011188 completed Feb. 26, 2007.

(Continued)

*Primary Examiner* — Jason M Greene
*Assistant Examiner* — Dung H Bui
(74) *Attorney, Agent, or Firm* — Brinks Hofer Gilson & Lione

(57) ABSTRACT

A vacuum cleaner filter bag with an inlet opening and a deflection device arranged in the area of the inlet opening, which is configured in such a way that an air stream flowing through the inlet opening can be deflected.

23 Claims, 4 Drawing Sheets

U.S. PATENT DOCUMENTS

| | | | | |
|---|---|---|---|---|
| 6,251,154 | B1 * | 6/2001 | van Rossen | 55/382 |
| 7,615,109 | B2 * | 11/2009 | Sepke et al. | 96/222 |
| 2003/0182908 | A1 * | 10/2003 | Zimet et al. | 55/374 |
| 2005/0098039 | A1 * | 5/2005 | Davis et al. | 95/273 |
| 2006/0191416 | A1 * | 8/2006 | Hirota et al. | 96/108 |
| 2007/0095031 | A1 * | 5/2007 | Zahuranec | 55/374 |

FOREIGN PATENT DOCUMENTS

| | | | |
|---|---|---|---|
| DE | 88 11 821.5 | U | 12/1988 |
| DE | 880 1638 | U1 | 7/1989 |
| DE | 910 1981 | U1 | 6/1991 |
| DE | 1 994 8909 | A1 | 4/2001 |
| DE | 2 010 1466 | U1 | 5/2001 |
| DE | 100 64 608 | A1 | 4/2002 |
| DE | 102 03 460 | A1 | 8/2002 |
| EP | 0 960 645 | A2 | 12/1999 |
| EP | 1 685 784 | A1 | 8/2006 |
| GB | 815709 | | 7/1959 |
| WO | WO 93/21812 | | 11/1993 |
| WO | WO 98/17164 | A1 | 4/1998 |

OTHER PUBLICATIONS

Official Action dated Oct. 9, 2009 for Chinese Application No. 200680043745X (with translation).

* cited by examiner

VACUUM CLEANER FILTER BAG WITH DEFLECTION DEVICE

This application claims the benefit under 35 U.S.C. §371 of International Application No. PCT/EP2006/011188, filed Nov. 22, 2006, which claims the benefit of European Application Nos. 05025480.4, filed Nov. 22, 2005; 05025904.3, filed Nov. 28, 2005; and 05027013.1, filed Dec. 9, 2005. These references are incorporated herein in their entirety.

The present invention refers to a vacuum cleaner filter bag with improved filter characteristics and enhanced service life.

The prior art discloses various types of vacuum cleaner bags which attempt in different ways to provide for good filter characteristics and a long service life.

It is e.g. known from EP 0 960 645 that a vacuum cleaner filter bag is provided with a filter structure in the case of which a coarse filter is arranged in front of a fine filter in the direction of the air stream from the inside of the bag to the outside. The coarse filter shows a high dust-storing capacity, so that dust particles are embedded in its pores over the whole thickness. Clogging of the filter material is thereby delayed, whereby the service life of the bag is increased.

WO 93/21812 discloses a vacuum cleaner filter bag in which a protective layer of a resistant material is provided on the bag wall opposite the inlet opening. This avoids a situation where the bag wall opposite the inlet opening of the bag is damaged by the particles directly impinging thereon at a high speed.

It is the object of the present invention to provide an improved vacuum cleaner filter bag in the light of the bag known from the prior art, the vacuum cleaner filter bag exhibiting an enhanced service life together with excellent filter characteristics.

This object is achieved with a vacuum cleaner filter bag according to claim 1.

According to the invention a vacuum cleaner filter bag is provided with an inlet opening and a deflection device arranged in the area of the inlet opening, which is configured in such a way that an air stream flowing through the inlet opening can be deflected.

Surprisingly, it has been found that the service life of such a vacuum cleaner filter bag is significantly increased while maintaining excellent filter characteristics. To be more specific, it has been found that the filter cake formed in a filter bag considerably contributes to the filtering behavior of the filter bag. Thanks to the deflection device provided according to the invention an air stream entering through the inlet opening is deflected such that the entrained particles are evenly distributed in the interior of the bag, thereby resulting in a uniform distribution of the developing filter cake and thus in an enhanced service life.

Furthermore, the deflection device has the advantage that the particles entrained in the air stream do not strike in an unimpeded way and at a high speed against the bag wall opposite the inlet opening to destroy the same.

According to a particularly preferred development of the present invention the deflection device can be arranged in the interior of the bag at the inlet opening. The deflection device can thus be connected in a particularly simple way to the vacuum cleaner filter bag. It is thereby possible to arrange the deflection device on the inside of the vacuum cleaner filter bag by way of an adhesive bond. Especially when the vacuum cleaner filter bag is to have a flat shape, this development permits a very advantageous technical production.

According to another development of the above-described invention the vacuum cleaner filter bag may further comprise a holding plate for holding the bag in a vacuum cleaner, wherein the deflection device is arranged on the holding plate and extends into the interior of the bag. According to this variant the combination of holding plate and deflection device may first be formed, and this combination may then be connected to the vacuum cleaner filter bag. To this end known methods can be used for fastening holding plates to vacuum cleaner filter bags. This development may be used in vacuum cleaner filter bags with a block bottom shape for a technically advantageous production.

According to a preferred development of all of the previously described vacuum cleaner filter bags the deflection device may be designed for dividing the air stream into at least two partial streams with different flow directions.

Such a division into two or more partial streams accomplishes an even more uniform distribution of the filter cake. Moreover, the number of the particles per particle flow is reduced in comparison with the entering air stream, which reduces the loading of the bag walls by the individual partial streams.

The deflection device of the described filter bag can be fastened to the bag inside, surrounding the inlet opening at least in part. This accomplishes, in particular, a stable arrangement of the deflection device which can reliably fulfill its task also at high flow rates.

To be more specific, the deflection device may comprise at least one deflection surface opposite the inlet opening. Said at least one deflection or baffle surface, in particular, helps to reduce the speed of the particles in a suitable way. The distance or average distance of such a deflection surface from the inlet opening depends on the size and shape of the vacuum cleaner filter bag.

The at least one deflection surface may be arranged at a predetermined angle relative to the plane of the inlet opening, particularly in parallel with the plane of the inlet opening.

The deflection of the air stream can be adapted to different parameters, such as bag geometry or dimensions, inflow angle, and can be optimized by selecting the angle in a suitable way. With a deflection surface arranged in parallel with the plane of the inlet opening, an air stream entering in a direction perpendicular to the plane of the inlet opening can be deflected by about 90°, which entails an advantageous distribution of the particles and of the resulting filter cake.

Preferably, the at least one deflection surface may have an area larger than the area of the inlet opening. This substantially avoids a situation where the air stream is just deflected around the deflection surface, but will then impinge at a substantially unchanged flow rate on the side opposite the inlet opening. Each deflection surface may have an area of 15 to 100 $cm^2$, particularly 40 to 60 $cm^2$.

In one development the deflection device of the previously described vacuum cleaner filter bag may comprise two trapezoidal or rectangular deflection surfaces which, starting from the inlet opening, converge towards each other in the manner of a wedge and are interconnected at a connection edge opposite the inlet opening.

To be more specific, on at least one end of the connection edge such a deflection device may comprise an outflow opening and an area which surrounds the inlet opening and which is connected to the inside of the bag and configured in the manner of a block bottom and comprises an inflow opening.

Block bottom shapes known from the sector of vacuum cleaner bags, as are e.g. described in DE 100 64 608, can thereby be used (in a reduced form) as deflection devices, with an outflow opening being provided in the instant case in one of or in both of the triangular sides, namely at the end of the connection edge. It should here be emphasized that the shape of the deflection device is chosen independently of the shape of the dust filter bag. Hence, the dust filter bag itself need not have a block bottom shape, even if this shape is provided for the deflection device.

In an alternative development the deflection device of the previously described vacuum cleaner filter bag may have the shape of a cuboid which in a first side surface surrounding the inlet opening and connected to the inside of the bag comprises an inflow opening and which in at least one further side surface perpendicular to the first side surface comprises an outflow opening.

The cuboid shape accomplishes a stable structure of the deflection device, with a suitable deflection or baffle surface being simultaneously formed for deflecting the air stream through the side surface of the cuboid opposite the inlet opening.

Particularly, each outflow opening may occupy the whole side surface of the cuboid. This prevents dust particles sucked in at a corner of the cuboid from accumulating.

In the case of a deflection device provided in the form of a cuboid, particularly at least two opposite outflow openings may be provided.

Said at least two opposite outflow openings have the effect on the one hand that the air stream is divided into two partial streams and on the other hand that said two partial streams have opposite directions, which on the whole results in a very homogeneous distribution of the filter cake in the vacuum cleaner filter bag.

The deflection device of the previously described vacuum cleaner filter bag may be configured in a development such that in a first position it has an extension reduced in size in comparison with a second position in a direction perpendicular to the plane of the inlet opening.

This means that the deflection device is collapsible or foldable. Thanks to the smaller extension in the second position, the vacuum cleaner filter bag can be given a very compact form, particularly prior to use. This is of particular advantage in the case of flat bags that can be folded for packaging purposes into specific sizes. Such foldable deflection devices prevent a state where the thickness of the folded bag is considerably increased. Preferably, the deflection device can be configured to be substantially flat in the second position.

To be more specific, the deflection device may be configured such that it can be brought by a vacuum stream from the first position into the second position.

As a result, during transportation the bag may comprise a deflection device in the second position with a smaller extension, which device during operation of the filter bag in the vacuum cleaner will then pass, for instance due to the negative pressure created by the suction of air in the bag, into its operative position in which it will then fulfill its deflecting function.

The above-described filter bags may comprise a restoring means which is configured such that the deflection device can be brought from the second position into the first position in response to a vacuum stream.

To be more specific, the deflection device may comprise a spring element which exerts a restoring force on part of the deflection device in such a manner that the deflection device can be brought in response to a vacuum stream from the second position into the first position.

Such a spring element makes it possible that, when the vacuum stream is decreasing, for instance when the vacuum cleaner is switched off, the deflection device returns again from the first position into the second position of reduced extension in a direction perpendicular to the plane of the inlet opening.

The deflection device may comprise fold lines, so that the deflection device can be brought from the first or second position into the second or first position. Such fold lines enable the desired folding or collapsing operation in a simple and reliable manner.

As an alternative to the described developments, the deflection device may however also be made rigid so that a folding operation is not possible.

With the previously described vacuum cleaner filter bags the deflection device may further be configured for closing the inlet opening.

This avoids an additional closing element which is often provided on the holding plate fastened to the outside of the vacuum cleaner filter bag, which considerably simplifies construction and manufacture of the vacuum cleaner filter bag.

Particularly, the deflection device, as described above, may comprise a spring element which exerts a restoring force on part of the deflection device so as to close the inlet opening.

This permits in a simple way the use of the deflection device as a closure for the inlet opening, which particularly dispenses with a separate closing element on a holding plate of the filter bag. Furthermore, in the case of such a deflection device, which also acts as a closing element, the vacuum cleaner filter bag is already closed before use and particularly during transportation, which permits the provision of particles present in bulk form in the vacuum cleaner filter bag, for instance odor adsorbents.

Furthermore, the previously described vacuum cleaner filter bags may comprise a sealing element, particularly for sealing the inlet opening.

With such a sealing element, the inlet opening, in particular, can be sealed around an introduced nozzle or pipe.

The sealing element can particularly be arranged between the inlet opening and the deflection device. This simplifies both the arrangement and the fastening of the sealing element. As an alternative, the sealing element may be arranged within the deflection device.

The material of the sealing element may particularly comprise rubber, an elastomer, a foil or foam, particularly closed-cell foam.

With an appropriate arrangement of the sealing element said sealing element can further permit an improved sealing of the inlet opening upon closing with the deflection device.

The deflection device of the previously described vacuum cleaner filter bag may particularly comprise a substantially airtight material. This has the advantage that the air stream and the entrained particles are deflected substantially entirely, so that particle deposits can particularly not accumulate on the deflection device.

The material of the deflection device may comprise cardboard, plastics, a nonwoven fabric or a foil. Other materials are also possible. An adequate stiffness of the material is particularly of advantage, so that the deflection device is not excessively moved by the air stream.

In the previously described vacuum cleaner filter bags, the deflection device may particularly be glued or welded to the filter material. For instance, the deflection device may comprise or may be coated with polyethylene or polypropylene at interconnect points with the inside of the bag. This makes it possible to fasten the deflection device and an outer holding plate comprising said materials by ultrasonic welding to the filter material of the bag wall at the same time.

Further features and advantages of the present invention will now be explained in more detail with reference to the embodiments illustrated in the figures according to a first constructional alternative and with reference to embodiments not described in conjunction with figures according to a second constructional alternative. To this end, FIG. 1 shows a view of a first embodiment of a deflection device according to the present invention;

Figure 1:
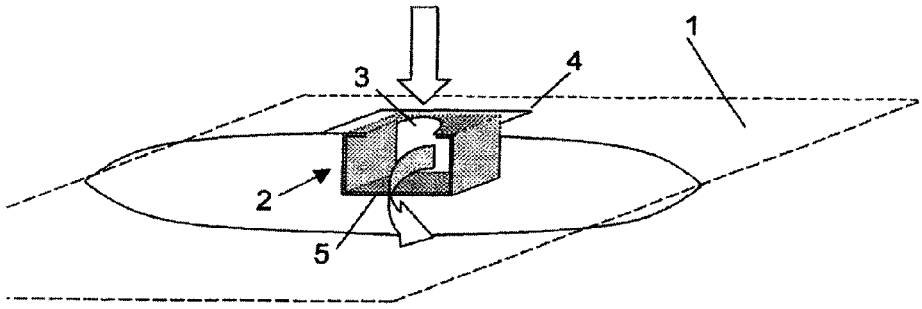
FIG. 1 is a view of an embodiment of a vacuum cleaner filter bag according to the invention.

In this figure the vacuum cleaner filter bag 1 is just sketched. In the interior of the filter bag a deflection device 2 is connected at the inlet opening 3 to the inside of the bag. On the outside of the bag a holding plate 4 is arranged for fixing the filter bag in a vacuum cleaner.

In the illustrated example, the deflection device 2 is shaped in the form of a cuboid. The base area 5 of said cuboid is arranged in parallel with the plane of the inlet opening 3 and fulfills the function of a deflection surface or baffle plate. Two of the side surfaces in a direction perpendicular to the baffle plate are each provided with an outflow opening (in the illustrated view at the front and rear), each occupying the whole side surface of the cuboid. The two other side surfaces (at the left and right side in the illustrated view) are closed. An air stream entering through the inlet opening 3 is thus divided into two partial streams that are deflected relative to the inflow opening by 90° and are flowing to the rear and front, respectively, into the bag.

The dimensions of the cuboid deflection devices may be 7.5 cm×8 cm×3 cm (width×depth×height) in the illustrated example. The material may e.g. be cardboard.

The illustrated embodiment can be modified in many ways.

First of all, a different orientation may be chosen for the deflection device, for instance, by rotating the cuboid by 45° relative to an axis perpendicular to the deflection surface and passing through its center. The partial streams can thereby be deflected into the corners of the bag.

Furthermore, it is possible to provide an outflow opening only in one or in three or in all side surfaces of the cuboid. The dimensions and materials can also be chosen that they are different.

The bag wall of the vacuum cleaner filter bag may e.g. have a structure as described in EP 0 960 645. To be more specific, a coarse filter layer, e.g. made from a meltblown, may be arranged in flow direction from the inside of the bag to the outside in front of a fine filter layer, e.g. also made from a meltblown. In addition, further layers may be provided in the filter structure, e.g. support layers and/or odor absorbing layers.

Figure 2:
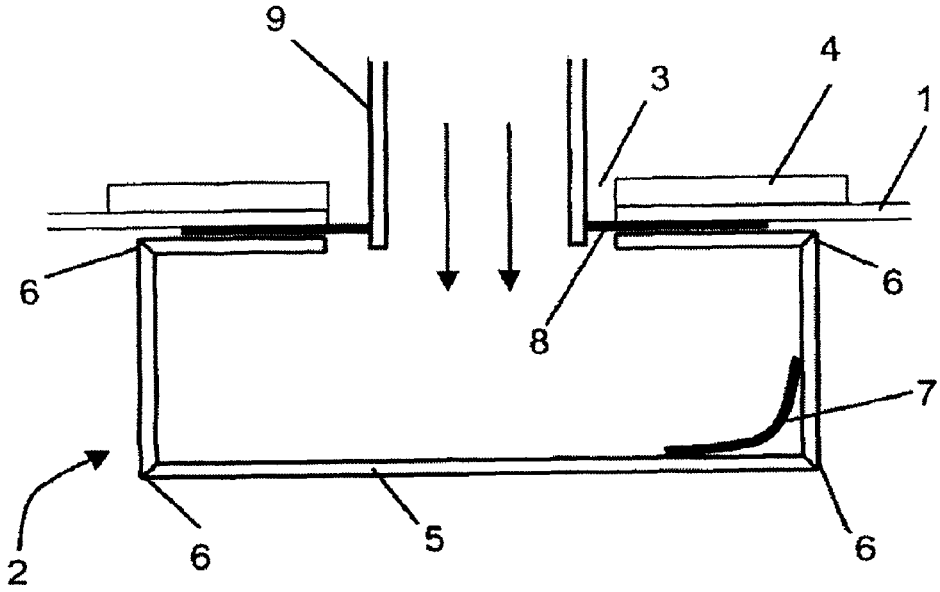
FIG. 2 shows a cross section through a further embodiment of a deflection device according to the present invention.

FIG. 2 schematically shows a further embodiment of a deflection device according to the invention. Like elements as in FIG. 1 are provided with like reference numerals.

The deflection device shown in cross section is here again illustrated in the form of a cuboid. In the illustrated embodiment, the side surfaces standing perpendicular to the base area 5 (deflection surface or baffle plate) are open at the front and rear to serve as outflow openings. The edges between the baffle plate and the two side surfaces or between the side surfaces and the upper area with the inflow opening have provided thereat fold lines 6 which make it possible to fold or collapse the deflection device to reduce the extension of the deflection device in size in a direction perpendicular to the plane of the inflow opening. As a result, correspondingly equipped vacuum cleaner filter bags can be collapsed in this position in a compact way and transported.

In the illustrated example there is further provided an (optional) spring element 7, which is here configured in the form of a bending spring. In the event of a vacuum stream, for instance when air is sucked in and a negative pressure is thereby generated in the interior of the bag, the deflection device is unfolded against the restoring force of the bending spring 7, thereby assuming its cuboid shape. With a weak or diminishing vacuum stream the bending spring 7 acts such that the side surfaces and the base area 5 are folded to the side (in the illustrated view to the left), so that the deflection device can be folded to assume a flat shape. In the flat-folded state the right side surface is then substantially in one plane with the base area 5. The bending spring 7 may e.g. be glued to the base area and the right side surface.

Such a collapsible deflection device may particularly also serve to reliably close the inflow opening and the inlet opening. A further closing element on the holding plate 4 is thus not needed.

As an alternative to the bending spring, a permanent magnet may e.g. also be provided in or on the holding plate 4, and a ferromagnetic element in or on one of the side surfaces or the base area 5. This also creates a restoring means which permits a folding of the deflection device upon a decreasing vacuum stream.

In addition, as shown in the example, a sealing element 8 may be provided, which is here arranged between the deflection device and the inside of the bag. As an alternative, the sealing element may also be arranged inside the deflection device on the upper surface in which the inflow opening is positioned. The sealing element is provided around the whole inlet opening. This sealing element particularly achieves a suitable seal after insertion of a pipe 9 that is connected to the vacuum cleaner hose.

Figure 3:
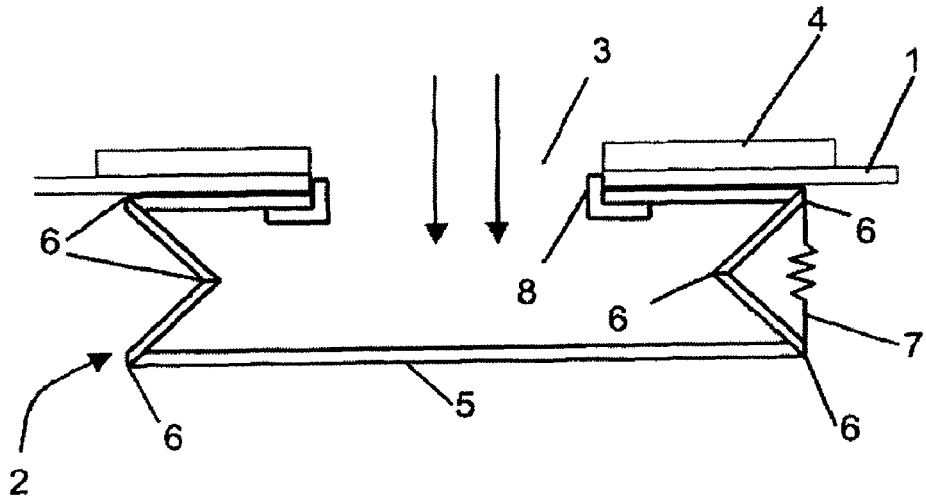
FIG. 3 shows a cross section through a further embodiment of a deflection device according to the present invention.

A further embodiment is schematically shown in FIG. 3. In this embodiment the deflection device may be folded in the manner of an accordion. To this end the two side surfaces arranged at the left and right side are each provided in their center with a fold line extending in parallel with the base area, on which the side surface can be folded. In this instance, too, a spring element 7 is provided and thanks to its restoring force the two side surfaces collapse and the base area 5 is moved in the direction of the inlet opening. The spring element may e.g. be integrated into one of the side surfaces as well.

In the embodiment as is here illustrated, the sealing element 8 is made of foam. Although said foam is applied in the interior of the deflection device, it projects into the inflow opening in the direction of the inlet opening. With a sealing element arranged in such a way it is not only an inserted pipe that is sealed; the inflow opening in the folded state of the deflection device is also sealed in an advantageous way. In this instance, too, the sealing element is arranged around the whole inflow opening and inlet opening.

In the previously shown examples, the deflection device can be connected in different ways to the inside of the bag. According to one option the deflection device is glued to the inner wall of the bag. Alternatively, the upper side of a deflection device, which is e.g. made from cardboard, may be coated with PE, so that when a PE holding plate is welded by way of ultrasound the deflection device is welded to the bag wall at the same time.

As an alternative to the described cuboid shape, the deflection device may also be shaped in the form of or similar to a wedge. To be more specific, the deflection device may be configured like a filter bag of reduced size with a block bottom, but without a holding plate, or the like, of its own. In the case of this form the block bottom with inflow opening is connected to the inside of the vacuum cleaner filter bag. Two holes as outflow openings are cut into each of the two small side surfaces of the deflection device at the wedge tip. The entering air is thus deflected by the broad side surfaces and the winding fold with the connection edge or the area formed in the region of the winding fold through the outflow openings. The advantage of this design of the deflection device is that it can also be collapsed in an easy way.

Figure 4:
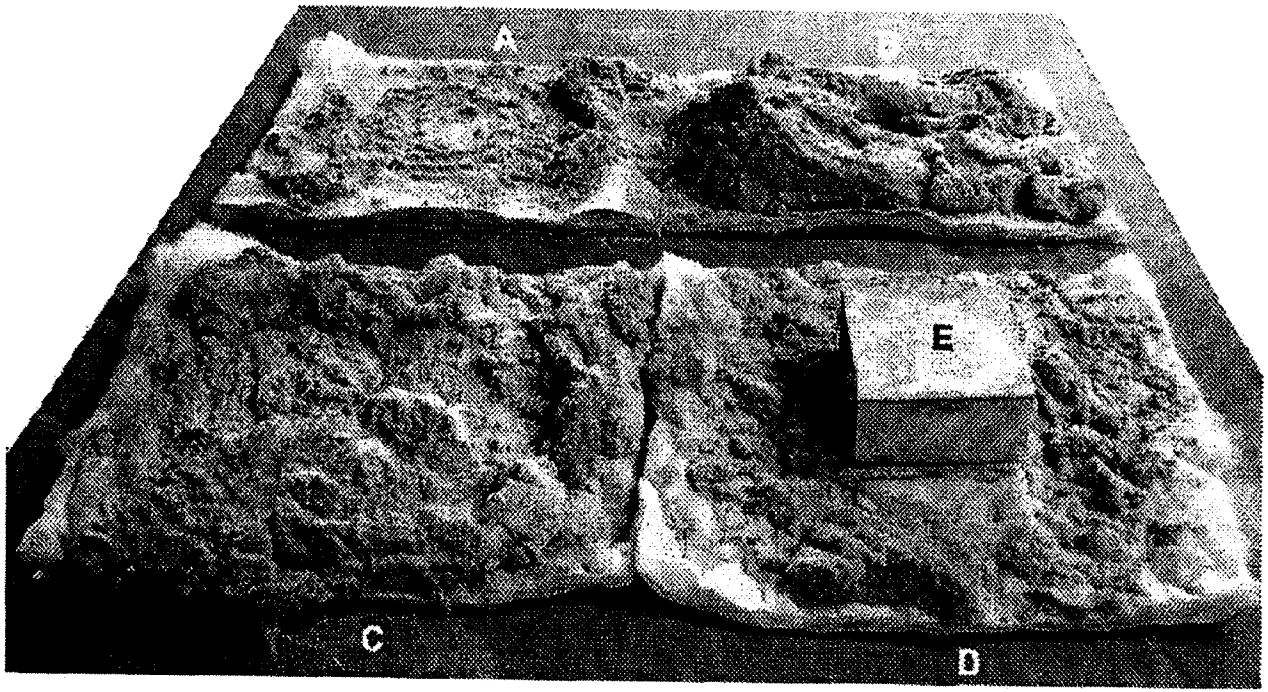
FIG. 4 shows a photo with a comparison of a conventional vacuum cleaner filter bag and a vacuum cleaner filter bag with a deflection device according to the present invention.

The advantageous effects of a deflection device according to the present invention are shown in FIG. 4. What can be seen are two cut flat bags that were loaded with 400 g test dust (DMT test dust type 8 of Deutsche Montan Technologie GmbH) before.

The vacuum cleaner filter bag arranged in the background of the figure is without a deflection device. The side of the bag designated by A is the inflow side, i.e. the side on which the entering air stream impinges in the interior of the bag. The side designated by B comprises the inlet opening, as can be seen in the middle of said side B. For this case without a deflection device it can clearly be seen that the filter cake predominantly rests on the inner wall of the bag at the inflow side. Hardly any filter cake has deposited at the opposite side.

In the foreground of the figure a flat bag that has also been cut on the surrounding edge and includes a deflection device according to the invention can be seen. The inflow side or the bottom side of the bag is designated by C, the upper side with the inlet opening by D. A cuboid deflection device of cardboard is arranged at the inlet opening. This deflection device comprises two opposite outflow openings, each occupying the whole left or right side surface (in the illustrated view). The deflection device has the above-mentioned dimensions 7.5 cm×8 cm×3 cm.

Loading with dust was here also carried out with the same amount of test dust (DMT type 8). As can immediately be seen, the filter cake in this case is here uniformly covered over the whole inner wall of the bag, both on the upper and on the lower side. As a consequence, the filter cake itself acts as a filter and permits the uniform inclusion of fine particulate matter.

Figure 5:
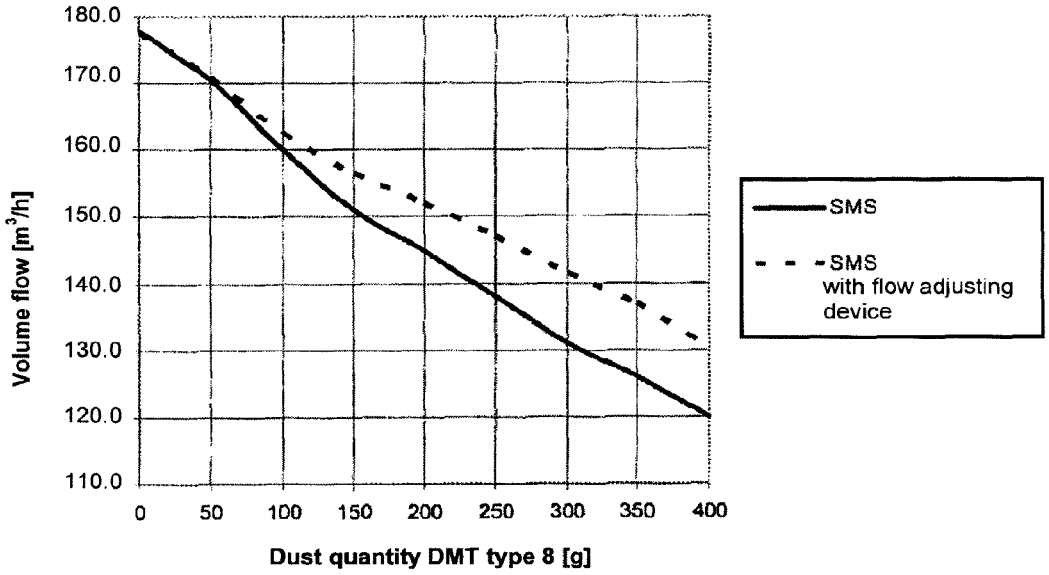
FIG. 5 shows a graph for illustrating the improved filter characteristics.
Figure 6:
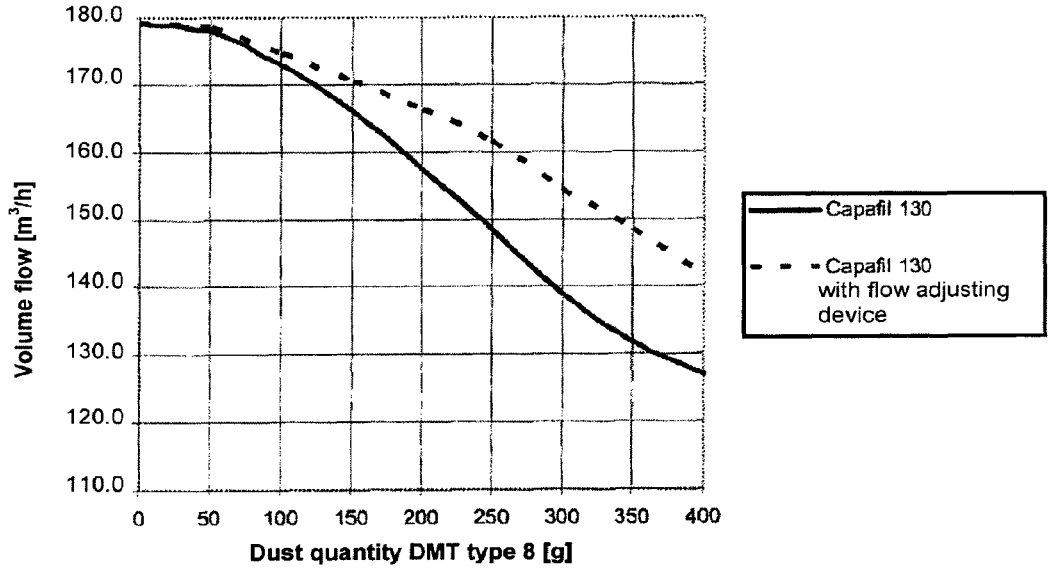
FIG. 6 shows a further graph for illustrating the improved filter characteristics.

The result of this improved distribution of the filter cake is also illustrated in the graphs according to FIGS. 5 and 6. In both cases a filter bag was tested, once without and once with a deflection device according to the present invention. The test method was carried out as follows.

The vacuum cleaner used was a Miele Performance 2300, type HS 05 (model S749, no. 71683038), which was set to maximum performance. Apart from the tested filter bag, the outblow filter and motor protection filter additionally provided for were also present. The tested vacuum cleaner filter bags had a flat shape and dimensions of 295 mm×270 mm. The deflection device had a cuboid shape, as shown in FIG. 4, with a height of 30 mm, a width of 75 mm, and a length of 80 mm. Two of the side surfaces with the dimensions 75 mm×30 mm were open and served as outflow openings. DMT type 8 was used as the test dust.

After a warm-up phase of the vacuum cleaner for 10 minutes the filter bag to be tested was installed. The volume flow (in $m^3/h$) without dust loading was measured after a running time of the device of 1 minute. Subsequently, a first dust portion of 50 g was sucked in within 30 s and the volume flow was then measured after 1 minute. This step was repeated for the subsequent dust additions accordingly until 400 g dust had been added.

The filter medium used for FIG. 5 was an SMS (spunbond/meltblown/spunbond), the spunbonds having a basis weight of 17 $g/m^2$, and the meltblown a basis weight of 24 $g/m^2$.

The filter medium used for FIG. 6 is the medium Capafil 130 (as of 2005), which is obtainable from the company Airflo N.V. It has the following structure: spunbonded fabric (17 $g/m^2$), volume fleece (130 $g/m^2$), spunbonded fabric (17 $g/m^2$), meltblown (24 $g/m^2$), spunbonded fabric (24 $g/m^2$).

As can clearly be seen from both graphs, the volume flow is decreasing at a significantly slower rate when a deflection device according to the present invention is used. This means that a filter bag is obtained with a reduced tendency to clogging and thus an improved service life with excellent filter characteristics.

All of the above-mentioned embodiments described with reference to the drawing can be modified according to a second constructional alternative such that the deflection device is not mounted on the inside of the bag in the area of the inlet opening, but the vacuum cleaner filter bag comprises a holding plate for holding the bag in a vacuum cleaner on which the deflection device is arranged such that it extends into the interior of the bag when the vacuum cleaner bag is ready for operation.

According to a first embodiment of this second constructional alternative, the vacuum cleaner filter bag has provided therein for this purpose a mounting opening which is so large that the deflection device fastened to the holding plate can be introduced through the mounting opening into the vacuum cleaner filter bag such that during operation of the vacuum cleaner it exhibits the above-described functions and effects. Furthermore, the holding plate must be somewhat larger than the mounting opening, so that it can be fastened on the outside of the vacuum cleaner filter bag to said bag.

Preferably, the fastening operation is here carried out such that the holding plate is tightly fastened with respect to the vacuum cleaner filter bag. The way of fastening is here chosen in dependence upon the material of the vacuum cleaner filter bag and the holding device. For instance, but not exclusively, vacuum cleaner filter bag and deflection device may be glued or welded, particularly by ultrasound.

In this embodiment the inlet opening is formed in the holding plate and preferably provided with a seal, so that an airtight closure is ensured between inlet pipe of the vacuum cleaner and vacuum cleaner filter bag. Depending on the material used for the holding plate, seals of rubber, foam or similarly suited materials can be used for this purpose.

Apart from the special features ensuing from the second constructional alternative, the vacuum cleaner filter bag can be configured as has been described with reference to the first constructional alternative. To be more specific, the deflection device may also be configured in very different ways, particularly as described above in connection with the first constructional alternative.

Moreover, the deflection device may advantageously be configured in the form of a broad strip consisting of dry-laid or wet-laid nonwoven or paper, particularly cardboard, or a foil. Apart from these materials, other materials may also be used; for instance, the deflection device may be made from plastics.

According to a second embodiment of the second constructional alternative a mounting opening may be provided in the vacuum cleaner filter bag, the mounting opening being so large that the deflection device as such can be secured to the outside of the vacuum cleaner filter bag. In this instance, too, suitable bonds or connections, for instance gluing or welding, are chosen for the materials used for the vacuum cleaner filter bag and the deflection device.

Finally, the connection between deflection device and vacuum cleaner filter bag has mounted thereon a holding plate of a corresponding size and the holding plate is secured to the combination of deflection device and vacuum cleaner filter bag. The deflection device, in turn, is thereby arranged on the holding plate.

The features of the vacuum cleaner filter bag that have nothing to do with the special constructional design can again be configured in very different ways, as are particularly described with reference to the various embodiments of the first constructional alternative and in connection with the first embodiment of the second constructional alternative.

According to a third embodiment of the second constructional alternative the holding plate is made from plastics. In this connection it is obvious to configure the deflection device as an integral part of the holding plate, so that the deflection device, in turn, is arranged on the holding plate. Expediently, the shapes of holding plate and deflection device are here chosen such that they can be manufactured in an injection molding process.

As an alternative to the third embodiment, holding device and deflection device may also be formed individually by way of an injection molding process in a fourth embodiment and then be fastened to one another in an appropriate way.

The observations made in connection with the first and second embodiment of the second constructional alternative are applicable to both the third and the fourth embodiment with respect to insertion into the vacuum cleaner filter bag and the attachment of the holding plate with deflection device with respect to the dimensions to be chosen and the materials to be used.

The invention claimed is:

1. A vacuum cleaner filter bag with an inlet opening and a deflection device arranged in an interior of the bag at the inlet opening, wherein the deflection device is adhered or welded to a filter material of a wall of an inner portion of the vacuum cleaner filter bag, surrounding the inlet opening at least in part and wherein the deflection device is configured to deflect an air stream flowing through the inlet opening and for dividing the air stream into at least two partial streams with different flow directions.

2. The vacuum cleaner filter bag according to claim 1, wherein the deflection device is configured for closing the inlet opening.

3. The vacuum cleaner filter bag according to claim 1, wherein the deflection device comprises a substantially airtight material.

4. The vacuum cleaner filter bag according to claim 1, further comprising a holding plate for holding the bag in a vacuum cleaner, wherein the deflection device is arranged on the holding plate and extends into an interior of the bag.

5. The vacuum cleaner filter bag according to claim 4, wherein the holding plate and the deflection plate are made from plastics.

6. The vacuum cleaner filter bag according to claim 1, wherein the deflection device has the shape of a cuboid wherein a first side surface surrounding the inlet opening and connected to an inner portion of the bag comprises an inflow opening and wherein at least one further side surface perpendicular to the first side surface comprises an outflow opening.

7. The vacuum cleaner filter bag according to claim 6, wherein each outflow opening occupies a whole side surface of the cuboid.

8. The vacuum cleaner filter bag according to claim 1, wherein the deflection device comprises a plastic material, a dry-laid or wet-laid nonwoven or paper, or a foil.

9. The vacuum cleaner filter bag according to claim 8, wherein the holding plate and the deflection device are made integral.

10. The vacuum cleaner filter bag according to claim 1, wherein the deflection device comprises two trapezoidal or rectangular deflection surfaces which, starting from the inlet opening, converge towards each other in a wedge shape and are interconnected at a connection edge opposite the inlet opening.

11. The vacuum cleaner filter bag according to claim 10, wherein the deflection device comprises an outflow opening on at least one end of the connection edge and an area which surrounds the inlet opening and which is connected to an inner portion of the bag, the deflection device further comprising a block bottom and an inflow opening.

12. The vacuum cleaner filter bag according to claim 11, comprising at least two opposite outflow openings.

13. The vacuum cleaner filter bag according to claim 1, wherein the deflection device comprises at least one deflection surface opposite the inlet opening.

14. The vacuum cleaner filter bag according to claim 13, wherein the at least one deflection surface is arranged at a predetermined angle relative to a plane of the inlet opening.

15. The vacuum cleaner filter bag according to claim 13, wherein the at least one deflection surface has an area larger than an area of the inlet opening.

16. The vacuum cleaner filter bag according to claim 1, comprising a sealing element for sealing the inlet opening.

17. The vacuum cleaner filter bag according to claim 16, wherein the sealing element is arranged between the inlet opening and the deflection device or within the deflection device.

18. The vacuum cleaner filter bag according to claim 16, wherein the sealing element comprises rubber, an elastomer, a foil or foam.

19. The vacuum cleaner filter bag according to claim 1, wherein the deflection device comprises a first position having a reduced extension size in relation to a second position extension size measured in a direction perpendicular to the plane of the inlet opening.

20. The vacuum cleaner filter bag according to claim 19, wherein the deflection device is configured such that a vacuum stream moves the deflection device from the first position into the second position.

21. The vacuum cleaner filter bag according to claim 19, wherein the deflection device comprises a biasing element to bias the deflection device from the second position into the first position.

22. The vacuum cleaner filter bag according to claim 21, wherein the biasing element comprises a spring or a magnet.

23. A vacuum cleaner filter bag with an inlet opening and a deflection device arranged in an area of the inlet opening, wherein the deflection device is configured to deflect an air stream flowing through the inlet opening, the deflection device comprising a first position having a reduced extension size in relation to a second position extension size measured in a direction perpendicular to the plane of the inlet opening and wherein the deflection device comprises fold lines, so that the deflection device can be brought from the first or second position into the second or first position.

* * * * *